United States Patent [19]

Sawvel

[11] Patent Number: 4,506,710

[45] Date of Patent: Mar. 26, 1985

[54] REVEL-ICE CREAM CONTAINER FILLING DEVICE

[76] Inventor: Thomas D. Sawvel, 10540 Ewing Ave. S., Bloomington, Minn. 55431

[21] Appl. No.: 496,889

[22] Filed: May 23, 1983

[51] Int. Cl.[3] ..... B65B 3/04; B65C 3/02

[52] U.S. Cl. ..... 141/100; 141/283; 141/374; 239/418

[58] Field of Search ..... 141/100–110, 141/9, 250–284, 186, 234–248, 302, 392, 369–381; 239/429, 1, 430, 431, 11, 418, 434, 434.5; 222/94, 129

[56] References Cited

U.S. PATENT DOCUMENTS

| | | | |
|---|---|---|---|
| 1,951,694 | 3/1934 | Goulstone | 141/100 |
| 3,509,920 | 5/1970 | Word | 141/100 |
| 3,881,529 | 5/1975 | Mannara | 141/100 |

*Primary Examiner*—Houston S. Bell, Jr.
*Attorney, Agent, or Firm*—James R. Cwayna

[57] ABSTRACT

A device for filling ice cream containers simultaneously with ice cream and a flavoring syrup to produce a reveled ice cream with the syrup being evenly and smoothly disbursed about the inner surface of the container to provide an attractive package which shows the flavoring syrup and to dispense the flavoring syrup also about the central or inner portion of the ice cream being delivered to the container. The filling device or head is utilized with ice cream filling equipment which provides ice cream and flavoring syrup pumping and transport means adjacent the inner surface of the container, and also provides for substantially smooth and equal delivery of the syrup to the interior portions of the ice cream.

14 Claims, 8 Drawing Figures

REVEL-ICE CREAM CONTAINER FILLING DEVICE

FIELD OF THE INVENTION

This invention relates generally to devices for the filling of ice cream containers with ice cream, and more specifically to the filling head for filling ice cream containers with ice cream and with flavoring syrup to provide a revel ice cream with the flavoring syrup being smoothly and attractively disbursed about the interior surface of the container and the central area of the container.

PRIOR ART

The applicant is well-skilled in the field of filling machines and is particularly well-skilled in the art of machines which are capable of and designed for filling containers with semi-liquid fluids such as ice cream, sour cream, cottage cheese, and the like. The utilization of such machines for creating revel ice cream has long been known in the art.

Revel ice creams and many other ice creams are often packaged in plastic, see-through containers and when utilizing a flavoring syrup, to provide a revel ice cream, it is desirous from an esthetic aspect to provide an attractive surface which is visible to the customer.

Many of the filling heads utilized for introducing flavoring syrups into the main body of the ice cream are not capable of both properly dispensing the syrup about the inner periphery of the container and providing equal and desired delivery of the flavoring syrup to the central portion of the ice cream filling the container. Obviously, with revel ice cream, an equal disbursement of the syrup is desirable. The applicant, being aware of the prior art, is knowledgeable of no filling devices which will produce this combined effect.

SUMMARY AND OBJECTS OF THE INVENTION

A summary statement of the invention is to provide an ice cream filling head which includes a flavoring syrup disbursement device for the introduction of flavoring syrup to provide a revel ice cream with the flavoring syrup being evenly distributed about the periphery of the contained ice cream and the central area of the ice cream being delivered.

It is therefore an object of the applicant's invention to provide an ice cream and flavoring syrup filling head for the filling of ice cream containers which will ensure introduction of the flavoring syrup both about the exterior periphery of the ice cream being filled and therefore adjacent to the inner periphery of the ice cream container and to provide for the introduction of the flavoring syrup generally centrally of the ice cream being delivered to the container.

It is a further object of the applicant's invention to provide an ice cream filling head which includes a flavoring syrup disbursement element closely associated therewith which head will simultaneously provide for the discharge of ice cream and discharge of the flavoring syrup into the container in an attractive and equal displacement and disbursement manner.

It is a further object of the applicant's invention to provide an ice cream container filling head which includes a filling head of substantially the same diameter of the container to be filled with a flavoring syrup introduction member arranged therewith and which syrup introduction member has delivery apertures adjacent the outer radial dimension of the filling head for disbursement of flavoring syrup adjacent the inner surface of the container being filled with additional means for introduction of the flavoring syrup generally centrally of the ice cream being delivered to the container.

It is a still further object of the applicant's invention to provide an ice cream filling device which includes a means for transferring ice cream from a source to a container and simultaneously transferring flavoring syrup to the delivered ice cream for equal and smooth disbursement of the flavoring syrup through the ice cream.

These, together with other objects and advantages will become apparent through a consideration of the following description of a preferred form of the invention which is made in conjunction with the accompanying drawings in which the same numeral or indicia is utilized to indicate the same or similar parts and structure.

DESCRIPTION OF A PREFERRED FORM OF THE INVENTION

Figure 1:
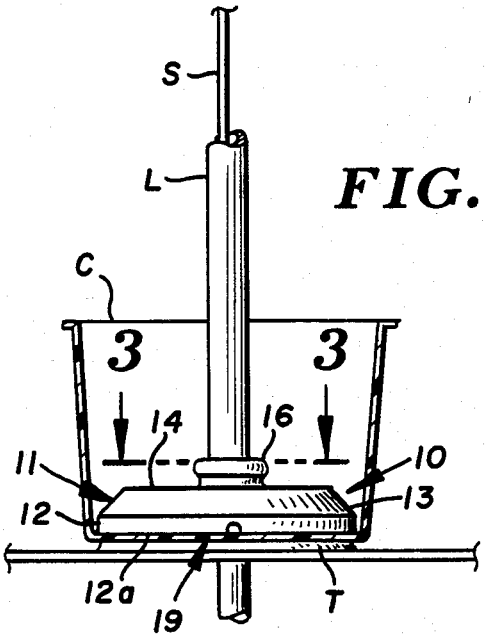
FIG. 1 is a schematic illustration of an ice cream container, the container shown in section, at the initiation of filling.
Figure 2:
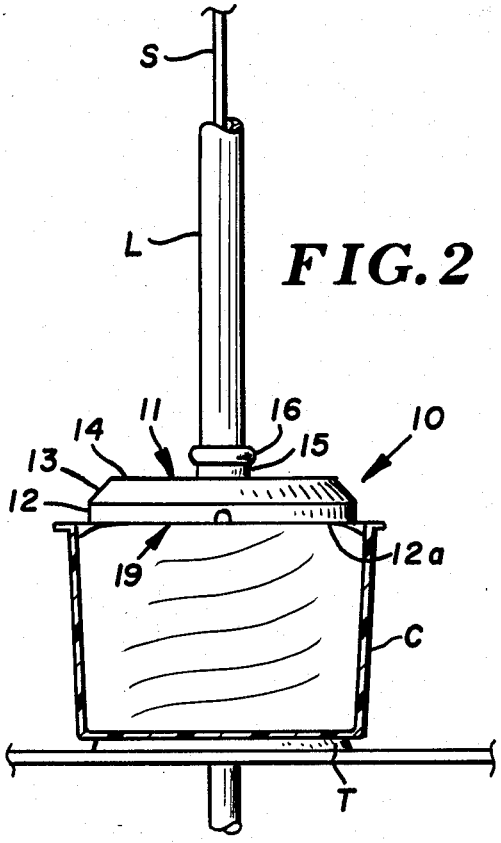
FIG. 2 is an illustration similar to FIG. 1 showing the filled container.

As illustrated in the accompanying drawings, the applicant's ice cream container filler head which includes a flavoring syrup dispensing section is generally designated 10 and is illustrated in FIG. 1 in conjunction with an ice cream container C positioned on a table T.

For certain purposes the table T may be rotative to rotate the container C as it is being filled. Such rotation, if the container is of a clear material, will result in a swirl effect.

It should be understood that the swirling effect may be obtained by rotation of table T or rotation of the head 10. The delivery of the ice cream and syrup may be made with a simple vertical motion.

An ice cream supply line L is provided to deliver ice cream from a pumping station to the head 10, and similarly, a syrup line S is provided to deliver flavoring syrup to the flavoring syrup dispenser portion of the filling head 10. The filling head 10 then is operated in conjunction with the required supply lines S and L and the table T to fill the container C.

In the form shown, the filling head 10 and the supply lines L and S are vertically moveable to extend to the lower extremity of the container C upon the initiation of filling and to rise to the top thereof as material is delivered to the container C. During this filling, the turntable T may be rotated for disbursement of the flavoring syrup through and around the ice cream that is being delivered into the container. The reasoning behind having control of the flavoring syrup, which is normally of a different color and flavor than that of the bulk ice cream is to provide even distribution through the ice cream and to provide an attractive display to the customer. The applicant's system is of particular importance when the container C is formed of a clear plastic or other transparent material. For consumer appreciation, a revel or flavoring syrup which is smoothly disbursed around the bulk ice cream will present an attractive package.

In the form shown, and in the description given herein, the head 10 and the accompanying lines S and L are moveable in a vertical direction. It should be obvious that the head 10 and the associated lines S and L are in a position elevated above the table T, and the table T and the positioned container C may be moved upwardly into filling position and dropped downwardly during filling while rotating the table T or head 10, and it should be obvious that either utilization may be provided in combination with the particular head 10 without departing from the scope of the invention.

The head 10 then provides a two-piece structure consisting of the ice cream delivering portion 11, and the syrup distributing portion 19. The ice cream delivering portion 11 is generally circular in configuration and provides a generally cylindrical portion 12 which is of a size to be received within the container C and cover the entire bottom area thereof. Arranged, primarily for design consideration, and in upwardly continuing relation to the cylindrical section 12 is a frusto-conical portion 13 terminating in a substantially, radially extending, flat upper surface 14 with an upwardly extending connector neck 15 arranged generally centrally thereof. A radially extending connective ring **15*a* is arranged on the upper surface of the upwardly extending neck 15, and a quick connector 16, which is familiar in the art, is provided to attach the head to the ice cream supply line L. A central passage 17 is arranged within the connective ring 15*a*, the upwardly extending neck 15, the frusto-conical portion 11 and the cylindrical portion 12. It is through this aperture 17** that the ice cream is supplied to the container C.

Obviously, the ice cream is in a semi-liquid stage, and will easily flow outwardly from the central aperture 17 to cover the entire area of the container C and the lower surface **12*a* of the cylindrical portion 12** will assist in evenly spreading the ice cream delivered to the container C and ensure proper filling thereof. As ice cream fills the container C, the ice cream creates pressure upwardly which will raise the entire filling head structure.

Figure 3:
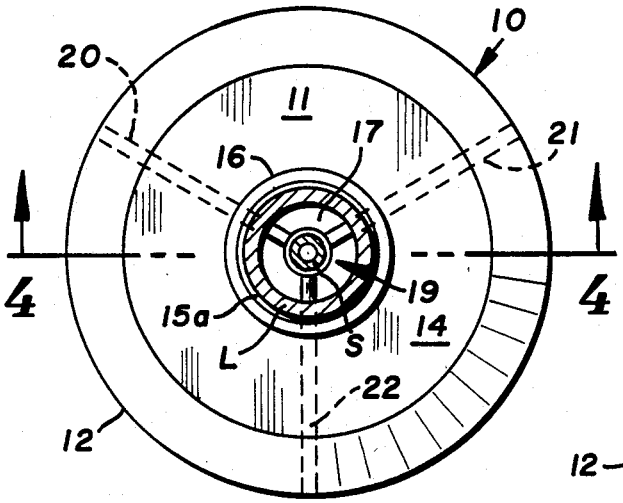
FIG. 3 is a top-plan view of the filling head embodying the concepts of the invention and taken substantially along Line 3—3 of FIG. 1.
Figure 5:
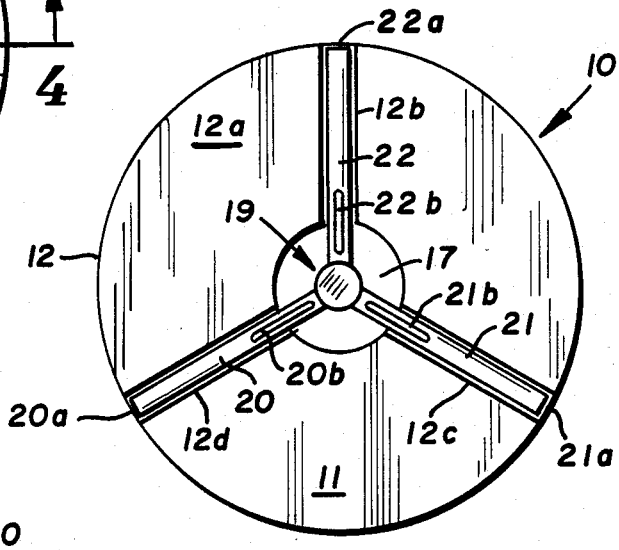
FIG. 5 is a bottom-plan view of the filling head taken substantially along Line 5—5 of FIG. 4 illustrating the flavoring syrup distribution element in conjunction with the filling head in one form of the invention.
Figure 4:
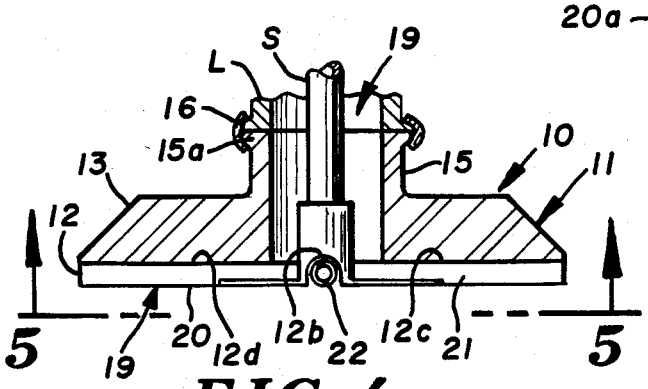
FIG. 4 is a vertical section taken substantially along Line 4—4 of FIG. 3.

In the form shown in FIGS. 3, 4, and 5, the fluid flavor dispensing section 12 consists of the supply line S extending to three radially extending arms, 20, 21, 22. Obviously, proper connections must be made through the syrup supply line S and syrup dispenser portion 19, to provide flow to the arms 20, 21, 22. As illustrated, and particularly shown in FIG. 5, a plurality of radially extending slots **12*b*, 12*c*, 12*d*, are provided in radially extending relationship from the ice cream receiving passage 17 and the tubular arms 20, 21, 22 are arranged therein such that they will lie in substantially planar relationship to the bottom surface 12*a* of the head 10**.

As illustrated in FIG. 5, these arms 20, 21, 22 extend radially outwardly to have their open ends **20*a*, 21*a*, 22*a* arranged adjacent the periphery of the cylindrical portion 12 of the head 10**. Then, it is obvious, the flavoring syrup will flow outwardly to be dispensed adjacent the inner peripheral surface of the container C.

As also illustrated in FIG. 5, downwardly directed slots **20*b*, 21*b*, 22*b*, are formed in the arms 20,21, 22 adjacent the central area thereof. The slots 20*b*, 21*b*, 22*b*, extend a radial predetermined dimension from a connector or joinder of the arms 20, 21, 22 to the supply line S and as illustrated, these slots 20*b*, 21*b*, 22*b* are preferably one-half or less the entire length of the individual arms. These slots 20*b*, 21*b*, 22*b* then act as dispensing apertures for the flavored syrup being delivered through the supply line S and each of the arms then has two dispensing areas. These two dispensing areas provide for the dispensing of flavoring syrup adjacent the inner surface of the container, and the dispensing of flavoring syrup adjacent the filling aperture 17 of the head 10**. As the turntable T and the container C are rotated, the flavoring syrup will be dispensed in an even manner about the internal surface of the container and likewise be smoothly dispensed about the center portion of the container and filled ice cream. This will provide an attractive package and will likewise properly dispense the flavoring syrup smoothly and evenly throughout the ice cream.

It should be obvious that, although the applicant has illustrated three such arms which are equally, angularly spaced with respect to the supply line S, a lesser or greater number of such arms could be provided, depending upon the particular density of flavoring syrup which is desired in the finally finished, filled container.

Figure 6:
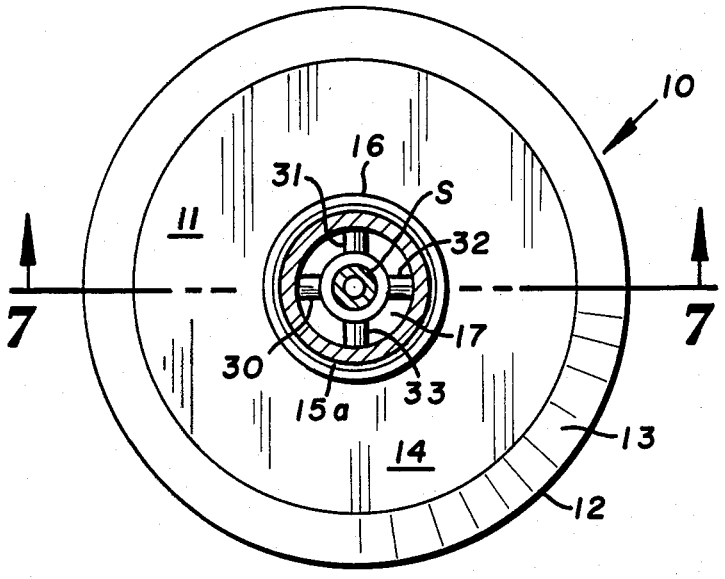
FIG. 6 is a top-plan view of the filling head embodying the concepts of the invention, being similar to FIG. 4, but showing a second embodiment of the invention.
Figure 7:
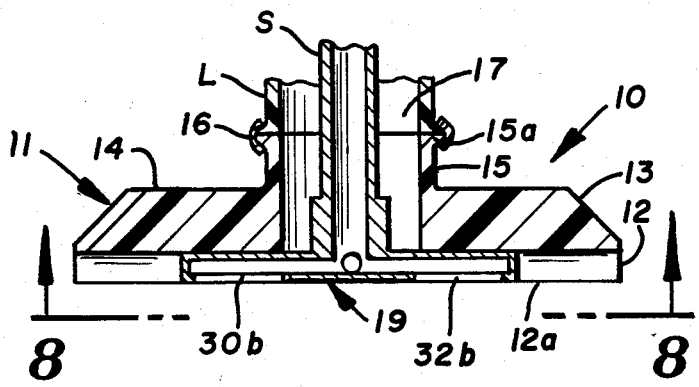
FIG. 7 is a vertical section taken substantially along Line 7—7 of FIG. 6; and, FIG. 8 is a bottom-plan view of the filling head and flavor syrup dispenser mechanism taken substantially along Line 8—8 of FIG. 7.
Figure 8:
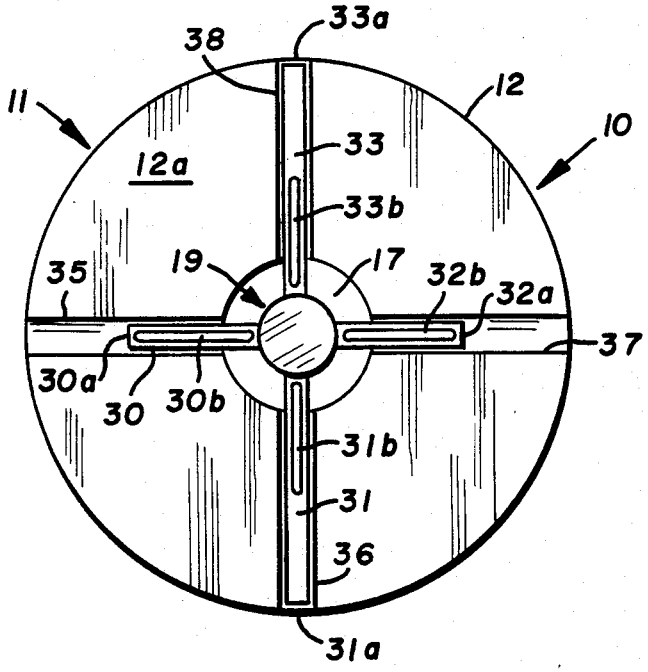

A modified form of the invention is illustrated in FIGS. 6, 7, 8.

In this particular form the head 10 is provided with the same basic numerals to describe the cylindrical portion 12, the frusto-conical surface 13, the flat surface 14, the upwardly-extending neck 15, the connecting ring element **15*a*, and the filling passage 17. The supply line shown is again designated S. It should be obvious that ice cream line L would also be provided. In this particular modification of the invention, a plurality of arm members are provided with the arm members being generally designated 30, 31, 32, and 33. The arm receiving slots designated 35, 36, 37, and 38, are again provided on the lower surface 12*a* of the filling disc 10 to receive the aforementioned arms 30, 31, 32, and 33 such that they will be in substantially planar relation with the lower surface 12*a* of head 10**.

The primary difference with this form of the invention is with regard to two oppositely disposed arms 30, 32. These arms 30, 32 are of a length which is one half or less than the length of the arms 31, 33. Arms 31, 33 extend the entire radial dimension of the head lower surface **12*a*, and are provided with open ends 31*a*, 33*a*, for the dispensing of flavoring syrup adjacent the inner surface of the container C, and these arms 31, 33 are similarly provided with downwardly directed slots 31*b*, 33*b*, arranged generally centrally of the head or disc 10**, and again, as shown, these slots extend to approximately one half the total radial dimension of the arms.

Arms 30, 32 are provided with closed ends, **30*a*, 32*a*, to prevent flow of flavoring syrup from the ends thereof, and are also provided with downwardly extending and arranged slots 30***b*, 32*b*.

This particular configuration will provide delivery means to the inner surface of the container through the open ends 31*a*, 33*a*, of dispensing tubes 31, 33, and will ensure a greater concentration of flavoring syrup to the innermost areas of the ice cream being filled into the container, due to the increased opening area afforded by, in the form shown, four downwardly directed slots 30*b*, 31*b*, 32*b*, 33*b*.

In FIGS. 6, 7, and 8, the applicant has chosen to illustrate four flavoring syrup distribution tube providing two radially extending flavoring syrup delivery lines and four downwardly directed flavoring syrup slots. Obviously, this arrangement provides a higher concentration of flavoring syrup being delivered generally centrally of the ice cream being placed in the container.

Again, although four such arms are illustrated, with the shorter arms being oppositely disposed of one another, a plurality of arm structures may be utilized and this could include one radially extending open-ended arm to extend to the inner surface of the container and one closed end arm. The angular configuration is of no importance to the invention but ease of manufacturing is obtained with the geometric arrangement provided. Obviously, with this long and short arm arrangement, a greater amount of syrup will be provided to the ice cream generally centrally of the container.

Obviously, for cleaning purposes, the flavoring syrup dispenser section 19 is separable from the filling head or disc 10.

It should be obvious that the applicant has provided a new and unique method for the dispensing of flavoring syrup for providing revel ice creams, the uniqueness lying in the proper utilization and dispensing of the flavoring syrup to form an attractively filled container, and one in which the flavoring syrup is equally disbursed through what may be termed the base or carrier ice cream.

What I claim is:

1. In combination with a container rotating device and an ice cream and syrup pumping mechanism, an ice cream and flavor dispensing head for filling containers to dispense the flavoring substance, adjacent the inner periphery of the container and centrally of the container for proper and appealing disbursement thereof, said head including:

a. a generally circular disc member of a diameter to be received in the container to be filled and extending substantially across the diameter thereof;

b. an ice cream dispensing aperture formed generally centrally of said disc:

c. means connecting said ice cream dispensing aperture to the ice cream pumping mechanism for delivery of ice cream through said disc into the container;

d. syrup flow conduit means arranged within said connecting means to deliver flavoring syrup through said disc;

e. the lower surface of said disc being provided with at least one radially extending slot;

f. at least one syrup directing means receiving syrup from said syrup flow conduit and arranged within said slot of said disc and extending radially to have an open end thereof arranged adjacent the inner peripheral surface of the container, the outer peripheral surface of said syrup directing means being substantially co-planar with the lower surface of said disc.

2. The structure set forth in claim 1 and said syrup directing means includes:

a downwardly directed slot formed in said syrup directing means adjacent the syrup receiving end thereof for syrup flow generally centrally of the container and delivered ice cream.

3. The structure as set forth in claim 2 and said downwardly directed slot extending radially along said syrup directing means to provide a radially extending flow of syrup generally centrally of the container.

4. The structure set forth in claim 3 and:

a. a plurality of radially extending slots being provided in the lower surface of said disc; and, b. at least one syrup directing means arranged in each of said slots.

5. The structure set forth in claim 4 and:

a. each of said syrup directing means being provided with a downwardly directed slot adjacent the syrup receiving end thereof; and, b. each of said downwardly directed slots extending radially along said directing means a predetermined radial distance.

6. The structure set forth in claim 1 and said syrup directing means including:

a. at least a first, radially extending syrup directing tube receiving syrup from said syrup flow conduit;

b. the outer end of said first tube being open to permit syrup flow adjacent the interior sides of the container;

c. at least a second, radially extending syrup flow conduit;

d. the outer end of said second tube being closed;

e. each of said tubes being provided with a downwardly directed slot adjacent the syrup receiving ends thereof and extending longitudinally along said tube a predetermined radial distance for syrup flow generally centrally of the container and delivered ice cream.

7. The structure set forth in claim 6 and said second tube being of less length than said first tube.

8. The structure set forth in claim 6 and said downwardly directed slot of said second tube extending the entire length thereof.

9. The structure set forth in claim 8 and the length of said second tube being generally one half the length of said first tube.

10. The structure set forth in claim 8 and the length of said second tube being less than one half the length of said first tube.

11. The structure set forth in claim 8 and at least a pair of said first tubes and a pair of said second tubes.

12. The structure set forth in claim 11 and said tubes being equally, angularly spaced.

13. The structure set forth in claim 11 and said first and second tubes being alternately positioned.

14. The structure set forth in claim 5 and said slots and said directing means being equally arcuately spaced about said disc.

* * * * *